United States Patent [19]

Fritscher

[11] Patent Number: 4,531,569

[45] Date of Patent: Jul. 30, 1985

[54] PROCESS AND APPARATUS FOR PRODUCING TUBES OF REACTIVE METALS

[75] Inventor: Klaus Fritscher, Cologne, Fed. Rep. of Germany

[73] Assignee: Deutsche Forschungs-Und Versuchsantalt Für Luft- Und Raumfahrt E.V., Cologne, Fed. Rep. of Germany

[21] Appl. No.: 470,780

[22] Filed: Feb. 28, 1983

[30] Foreign Application Priority Data

Mar. 4, 1982 [DE] Fed. Rep. of Germany ..... 3207777

[51] Int. Cl.[3] ..... B22D 11/00

[52] U.S. Cl. ..... 164/464; 164/421; 164/465; 164/474; 164/475; 164/485

[58] Field of Search ..... 164/421, 464–465, 164/474–475, 485

[56] References Cited

U.S. PATENT DOCUMENTS

| | | | |
|---|---|---|---|
| 3,398,780 | 8/1968 | Yearly | 164/465 |
| 3,721,286 | 3/1973 | Paton et al. | 164/470 |
| 3,724,529 | 4/1973 | Chaulet et al. | 164/421 |

FOREIGN PATENT DOCUMENTS

| | | | |
|---|---|---|---|
| 1399620 | 4/1965 | France | 164/465 |
| 0607386 | 8/1960 | Italy | 164/464 |
| 4539344 | 12/1970 | Japan | 164/465 |

*Primary Examiner*—Nicholas P. Godici
*Assistant Examiner*—Richard K. Seidel
*Attorney, Agent, or Firm*—Birch, Stewart, Kolasch & Birch

[57] ABSTRACT

To produce tubes of reactive metals, a melt (14) is removed from the annular gap (13) of a crucible (10). The temperature of the melt (14) is such as to ensure the formation of the solidus-liquidus zone (33) directly behind the annular gap (13), a planar solidification front (34) being created in a non supported region which is not exposed to the direct influence of a cooling means. In the subsequent region, the oriented solidification of the tube with high temperature gradients is realized, and the tube can be shaped or adjusted free of thermal influences. Only thereafter, the tube (25) is exposed to the action of cooling means (26, 31) to cool it without contact. In such a way, it is possible to produce tubes having a high stability and resistance to temperatures for use in turbines, heat exchangers or the like.

15 Claims, 3 Drawing Figures

PROCESS AND APPARATUS FOR PRODUCING TUBES OF REACTIVE METALS

Figure 1:
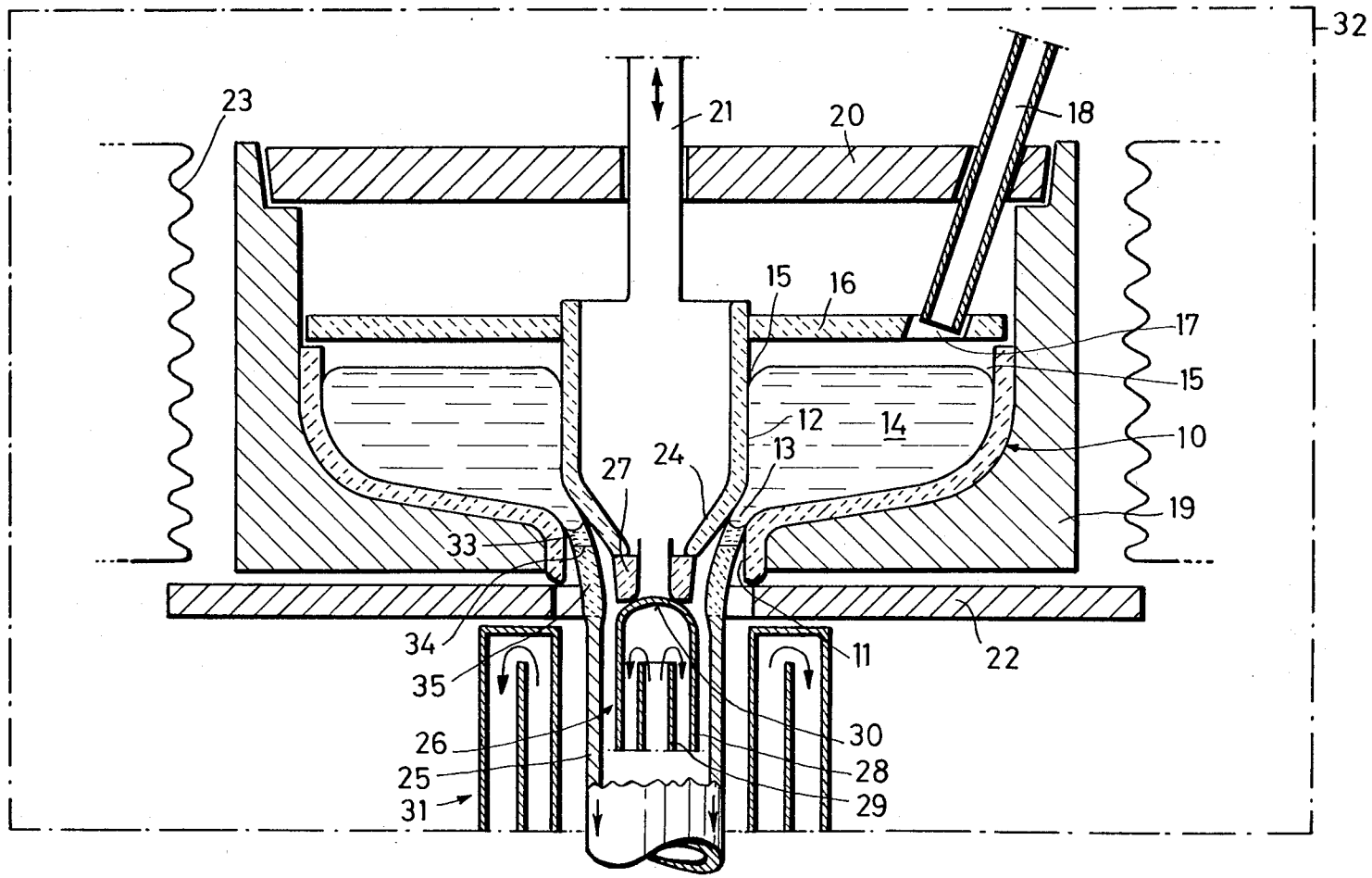

The invention relates to a process for producing tubes of reactive metals comprising removing from a crucible through an annular gap a melt for its continuous solidification and to an apparatus for performing said process.

It has been known to produce tubes by continuously withdrawing melt from an annular gap in the bottom wall of a crucible (DE-AS 23 21 064, DE-OS 19 23 471). In such a process, the inner wall of the annular gap is formed by a hollow cooling mandrel which contains a coolant. The cooling mandrel can be porous so that the coolant penetrates its wall to escape between the cooling mandrel and the tube. In this case, the tube does not directly adjoin the cooling mandrel. The melt solidifies in the region of the cooling mandrel—i.e. in the zone of the annular gap forming the tube. In the cross section of the tube wall, the solidification front is strongly deflected downwardly towards the wall center thus entailing an imperfect structure in the centre of the tube wall. With solidification starting of the external and internal faces of the tube wall in the region of the cooling mandrel, lubricant must be provided in the annular gap. Therefore, the known tube production process does not lend itself to be used for strongly reactive metals which must be processed in a vacuum or in a protective gas atmosphere, because the lubricants will be evaporated. Due to the low temperature gradient in the travel direction of the tube, the tubes produced according to the known processes tend to form threadlike cavities in the centre of the casting. This is due to the fact that the material inside the casting solidifies last of all, while a complete subsequent feeding of further melt into the cavities caused by the solidification shrinkage does not take place.

Furthermore, there have been known electro-slag resmelting processes (U.S. Pat. No. 3,683,997, U.S. Pat. No. 3,721,286) which can be used for alloys containing certain amounts of reactive metals. In said known processes, the melt is continuously withdrawn from a crucible open downwardly, with the use of a cooling mandrel. The solidification of the melt begins between the lower region of the crucible wall and the cooling mandrel. A solidification front is formed which, from the outside and the inside of the tube jacket propagates to the wall inside, thus giving rise to the risk of threadlike cavities.

Last of all, it has been known with crystal growth procedures to continuously withdraw from a crucible a melt to cause it subsequently to solidify by cooling.

It is the object of the invention to provide a process and an apparatus of the mentioned type to process reactive metals in a vacuum without the use of a lubricant to obtain tubes which have a dense structure across the wall cross section and which withstand the highest mechanical stresses and temperatures.

The problem is solved, according to the invention, in that the melt, in liquid condition, is passed in a vacuum or in a protective gas atmosphere through the annular gap or at a point at which the tube material is not in contact with any of the walls of the surrounding tube forming apparatus, its contactless solidification beginning only behind the annular gap.

It is a particular advantage of the process of the invention that a cooled shaping mandrel need not be used so that the melt is discharged from the crucible according to the crystal growth procedure. Within the range of shaping of the tube wall, there is no contact with other elements and no positive cooling either. Cooling starts suddenly and without any contact, exclusively by coldness radiation from the cooling means, upon the discharge of the melt from the annular gap. Due to the quick solidification, the resultant crystalline structure is free of defects, ensuring high durability, stability and resistance to temperatures. Cooling is perfomed uniformly over the total wall cross section thus excluding threadlike cavities and bringing about a high material density in the tube wall. The melt solidifies with a high, vertically extending temperature gradient. Due to shrinkage caused by the solidification, the melt is detached from the discharge lip of the annular gap.

The tubes produced according to the process of the invention are extremely free of segregations, their microporosity being also extremely low. An oriented grain structure is formed in the tube material. If the internal tube is under stress, the maximum stress vector is vertical on the grain boundaries. The unfavorable grain angle position of 45°, causing at high temperatures a gliding of the grain boundaries, is avoided to a far extent.

Generally speaking, the process of the invention allows for the processing of tubings of casting materials and also of wrought alloys in one sole step to obtain tubes of dimensional accuracy. The process is very suitable for nickel- and cobalt casting alloys which are processed to turbine blades for industrial and aircraft engines. The alloys are provided for conditions of high mechanical stress and extreme temperatures under oxidizing, corrosive conditions. They may be also used in heat exchangers. The low density of grain boundaries in the tube structure and the possibility of completely eliminating the grain boundaries as a result of the process (production of monocrystalline tubes) permits a reduction of the requirement of the content of grain boundary reinforcing elements such as for example carbon, in the alloys. Thus, the resistance to corrosion of the basic material in hot gas atmospheres can be changed favorably.

According to the process, the melt may be withdrawn from the crucible either in an upward or downward direction. For the upward withdrawal, an inoculating tube is conveniently used.

An apparatus for performing the process of the present invention by withdrawing the melt in a downward direction from the crucible is provided with an opening in the bottom wall of the crucible to house a discharge plug, forming with said opening the annular gap, the apparatus being characterized in that the wall of the crucible and of the discharge plug forming the annular gap are not cooled. The melt is formed upon discharge from the annular gap in a free run without any support. Cooling is performed subsequently by contactless coolants.

In an apparatus having a crucible whose bottom wall is closed to the passage of the melt, a preferred embodiment of the invention provides a crucible containing an insert body dipping into the melt and having an upward opening annular chamber which is filled with the melt. From the annular chamber, the melt is removed in its free run to the top, the tube being formed in the manner of a crystal growth procedure. The solidification front of the tube extends at a right angle to the tube wall.

According to a preferred embodiment of the apparatus of the invention, at least one of the annular gap walls consists of a material which is poorly wettable with the material of the melt, the walls of the annular gap being flared towards its discharge end. This facilitates detaching of the melt from the annular gap in the support-free tube formation.

Alternatively, the walls of the annular gap may also consist of a material well wetted with the melt material, the discharge end of the annular gap being substantially cylindrical. Thus, the wall thickness of the resultant tube is superior to the width of the annular gap.

For the cooling of the solidified tube, a cooling means is suitably provided inside the tube at a distance from its wall and thermally insulated against the wall portions which form the annular gap. Thus, the cooling means cannot influence the tube formation upon the discharge of the melt from the annular gap. With a downward removal of the melt the thermal insulation should be arranged between the discharge plug and cooling means cooling contactlessly the solidified tube. With an upward withdrawal of the tube, the insert body has a longitudinal channel for the passage of a cooling line extending into the solidified tube, thermal insulation being fitted between the cooling line and the wall of the insert body.

With reference to the enclosed drawings, some embodiments of the invention will be explained hereinafter in more detail.

Figure 2:
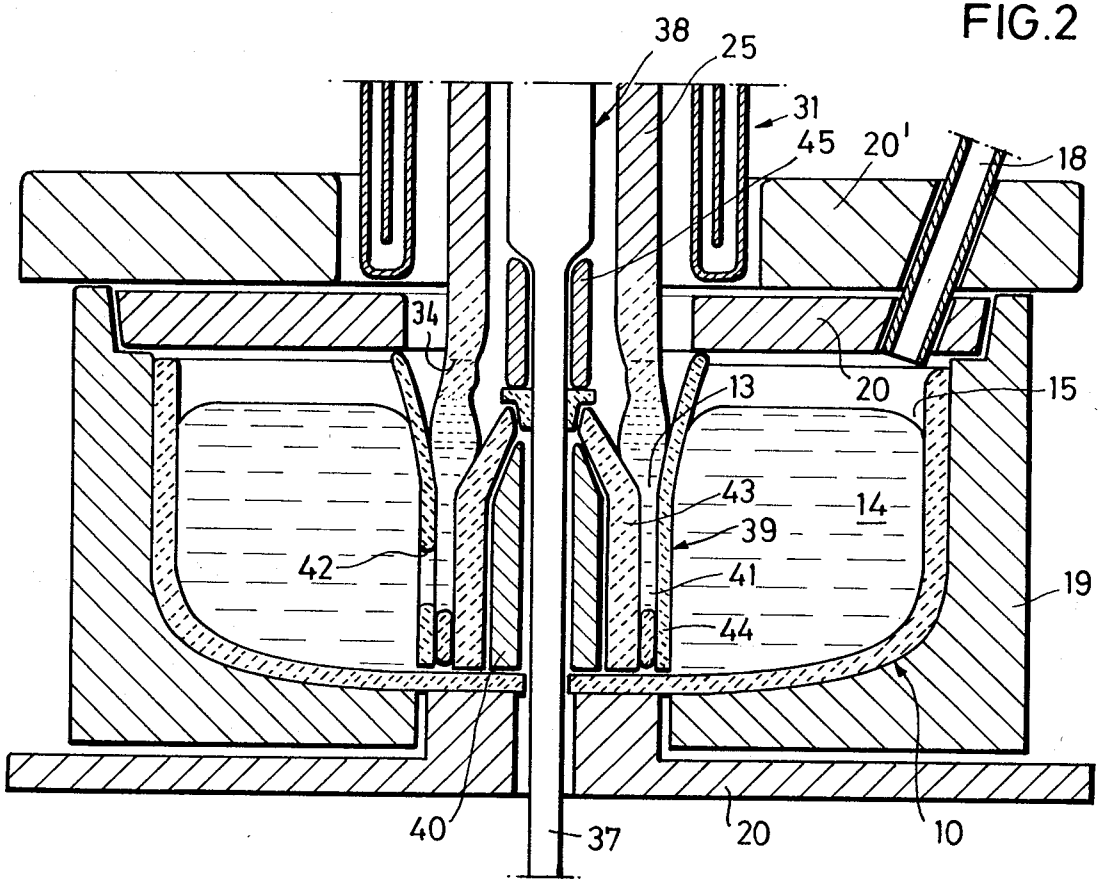
Figure 3:
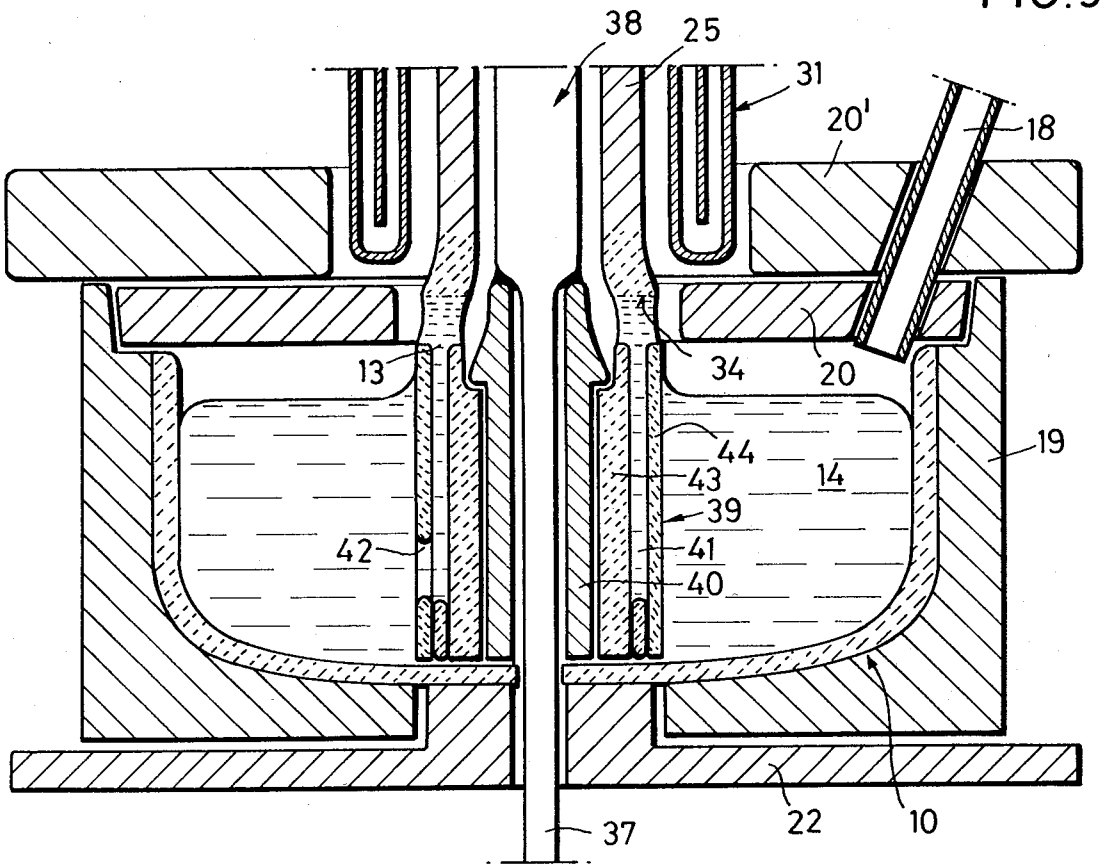

FIG. 1 is a schematic longitudinal section of a first embodiment of the invention, FIG. 2 is a schematic longitudinal section of a second embodiment of the invention in which the melt is evacuated in an upward direction, and FIG. 3 is a third embodiment of the invention in which the melt is also evacuated upwardly.

According to the embodiment of FIG. 1, the bottom wall of the crucible 10 includes an annular aperture 11 which, together with the discharge plug 12, which is adjustable in height, forms the annular gap 13 for the outlet of the melt. The discharge plug 12 arranged coaxially in the aperture 11, is hollow and, just like the crucible 10, consists of a high temperature resistance material, e.g. of pure sintered corundum. This material is wetted poorly by the material of the melt 14 present in the crucible 10 so that, at the points of contact of the melt 14 with the crucible 10 and with the discharge piece 12 made of the same material as the crucible, deep rim zones 15 are formed.

The top of the crucible 10 is closed by a cover plate 16 which comprises a central aperture for the passage of the discharge plug 12 adjustable in height, and an additional aperture 17 which is connected to a material feeder 18.

The crucible 10 is housed in a holder 19 made of well heat-conducting material. Above the cover plate 16, the holder carries an insulating plate 20 through which extend the adjusting rod 21 connected to the discharge plug 12 and the material feeder 18. In the downward direction, the crucible 10 and the holder 19 are insulated by an additional insulating plate 22.

Heating of the crucible 10 is achieved by a heating means 23 enclosing laterally the holder 19 and the crucible 10, thus maintaining uniformly the total melt at a temperature slightly above its solidification temperature.

The lower end 24 of the discharge plug 12 limiting internally the annular gap 13 is tapered conically downwardly. Between the lower end of the discharge plug 12 and a cooling means 26 situated inside the solidified tube 25, there is located a heat insulating body 27 to inhibit the cooling effect at the annular gap 13. The cooling means 26 consists of two coaxial pipes 28 and, 29. The end wall 30 of the outer pipe 28 is below the annular gap 13 at a predetermined distance therefrom. The inner pipe 29 serves for supplying a cooling fluid. It is shorter than the external pipe 28 so that the cooling fluid which is discharged from the inner pipe 29 is diverted below the front wall 30 to flow back between the inner pipe 29 and the external pipe 28. The outer diameter of the cooling means 26 is less than the inner diameter of the solidified tube 25, the cooling being performed without contact and only by radiation.

Around the solidified tube 25, an external cooling means 31 is mounted through which a cooling agent is circulated and whose inner diameter is greater than the outer diameter of the solidified tube 25 so that the external cooling of tube 25 is also realized exclusively by radiation.

The total assembly disclosed above is arranged in a vacuum-tight container 32 thus permitting the tube production under vacuum or in a protective gas atmosphere.

In the melt 14, there is formed directly subsequent to the annular gap 13 the solidus/liquidus zone 33 which is limited downwardly by the planar solidification front 34, followed by the shrinkage section 35 reaching approximately to the upper ends of the cooling means 26 and 31. When the tube has reached the area between the cooling means 26 and 31, it has already received its final shape.

The crucible 10 is flat, i.e. is building height is reduced thus allowing to adjust the temperature of the melt 14 to ensure that the solidus-liquidus zone 33 adjoins directly the annular gap 13 on account of the moderate metallostatic pressure. It is possible to change the width of the annular gap 13 by adjusting the height of the discharge plug 12.

In the embodiments of FIGS. 2 and 3, elements having substantially the same function as the corresponding elements of the embodiment of FIG. 1 are identified by the same reference numerals although their configuration may vary in some details.

In the embodiment of FIG. 2, the crucible 10 does not permit the melt 14 to pass in a downward direction. In its bottom wall, it contains an opening for the sealed passage of a cooling line 37 extending vertically and centrally through the crucible 10 to the cooling means 38 which is inside the solidified tube 25. A bipartite high insert body 39 is provided coaxially about the cooling line 37 and contains in its inner space a heat insulating material 40 to thermally insulate the insert body wall from the cooling line 37. The insert body 39 is provided with a ring channel 41 with a radial opening 42 to the outside. Through this opening 42 situated in the lower region of the crucible 10, the melt 14 can flow into the ring channel 41 which is filled accordingly. The ring channel 41 is limited by the inner wall 43 and the outer wall 44 of the insert body 39. Within the area of the annular gap 13 or at the upper end of the insert body 39, the outside of the inner wall 43 is tapered upwardly while the inside of the outer wall 44 is conically enlarged upwardly. Just like the material of the crucible 10, the material of the insert body is poorly wettable by the melt 14. Hence, first of all, the melt in the annular gap 13 is deeper than the bath level of the remaining crucible volume. At the start of the tube drawing process, a (non-illustrated) metallic inoculating tube is introduced from above into the annular gap 13 to contact the melt. When the inoculating tube is slowly lifted, the melt is drawn up while the tube is growing. Between the upper end of the inner wall 43 of the insert body 39 and the inner cooling means 38, there is a heat insulating pipe 45 to form a shield against the cooling pipe 37 at the point where the solidus-liquidus zone 34 is formed. In addition, the embodiment of FIG. 2 includes another heat insulating plate 20' above the plate 20 to inhibit heat reflection from the crucible 10 into the region of the outer cooling means 31. The cooling means 38 and 31 are provided at a vertical distance from the annular gap 13 and the horizontal solidification front 34 of the tube is formed between the annular gap 13 and the cooling means 38 and 31 without a positive external cooling. No external or internal support of the tube under formation is performed in the solidification zone.

The embodiment of FIG. 3 is similar to a far extent to that of FIG. 2 so that only the differences will be explained hereinafter. According to FIG. 3, at least one of the two walls 43 or 44 of the insert body 39 is made of a material well wetted by the melt 14, as for example tantalum carbide (TaC). The melt rises through the capillary ring channel 41 to the annular gap 13. To initiate the tube-drawing process the melt is contacted by an inoculating tube as explained in the preceding embodiment.

According to FIG. 3, the shapes of the inner pipe 43 and of the external pipe 44 of the insert body 39 are substantially cylindrical to their upper ends, the extension of the capillary ring channel to the annular gap 13 at its upper end being cylindrical accordingly. The annular gap 13 is above the level occupied by the melt 14 in the crucible 10. In the instant case, the heat insulating tube 40 which encloses the cooling line 37 extends to beyond the upper end of the inner pipe 43 and to the inner cooling device 38 thus shielding the inside against cooling the area in which the solidus-liquidus zone 33 is formed.

In accordance with FIG. 1 the equipment of the embodiments illustrated in FIGS. 2 and 3 is mounted in a vacuum-tight container 32, in which the units can be processed in a high vacuum (i.e. at a pressure in the order of $10^{-3}$ mbar) or under highly purified inert gas. It is also possible to use gas mixtures which are compatible with the alloys of the melt.

Some examples of material for casting alloys processible with the facilities of the present invention are listed hereinafter:

1. nickel-casting alloys containing in particular
   up to 6% by weight of aluminum and
   up to 6% by weight of titanium for the substantial $Ni_3(Ti, Al)$-precipitation hardening and probably containing
   up to 20% by weight of cobalt,
   7 to 25% by weight of chromium
   up to 0.2% by weight of carbon
   and up to 12% by weight of Mo, Ta, W for mixed crystal hardening
2. cobalt-casting alloys containing particular
   up to 10% by weight of Mo, Ta, W and
   up to 1% by weight of carbon for the substantial special carbide formation and separation
   20–30% by weight of chromium.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A process for producing tubing of high temperature resistant metals comprising:

providing a crucible containing a reactive high temperature resistant metal in a melted state within a controlled environment, rmoving said melt from said crucible through an annular gap and introducing said melt into a cooling zone, substantially continuously solidifying said melt into a tube of material, said melt first passing in a freely-suspended state through a solidus-liquidus zone during the initial solidification thereof beyond said annular gap before passing into said cooling zone, said cooling and insuing solidification into said tubular material of said melt being achieved substantially exclusively by a gradual heat radiation process.

2. The process of claim 1, wherein said controlled environment is a vacuum.

3. The process of claim 1, wherein said controlled environment is a highly purified inert gas.

4. The process of claim 1, wherein said controlled environment is a gas mixture compatible with the alloys of the melt.

5. The process of claim 1, wherein said high temperature resistant metal is selected from at least one of a nickel alloy or a cobalt alloy.

6. The process according to claim 1, wherein said melt is removed downwardly from said crucible.

7. The process according to claim 1, wherein said melt is removed upwardly from said crucible by an inoculating tube.

8. An apparatus for producing tubing of high temperature resistant metals, such as nickel and cobalt alloys, comprising:

a crucible for retaining said high temperature resistant metal in a melt state, a means for forming an annular gap within said crucible through which said melt is removed from said crucible into a cooling zone for solidification into said tubing, and cooling means for gradually solidifying said melt substantially exclusively by heat radiation beyond said annular gap located both internal and external to said solidifying tubing, said cooling means positioned radial to said tubing, all of said crucible, annular gap forming means and cooling means being housed in a gas-tight container.

9. The apparatus of claim 8, wherein said annular gap forming means comprises an insert body coaxially positioned within said crucible, in said melt, comprising an upwardly open annular channel having inner and outer walls substantially cylindrical at their upper ends forming said annular gap, at least one of said walls being made of a material wettable by said melt.

10. The apparatus of claim 9, further including an inoculating tube for removing said melt from said annular gap in the form of said tubing.

11. The apparatus according to claim 8, wherein said cooling means is thermally insulated from said annular gap.

12. The apparatus according to claim 8, wherein said crucible and said annular gap forming means consist of a material poorly wettable by said metal in said melt state and respective walls at said annular gap are flared.

13. The apparatus of claim 12, wherein said crucible comprises an opening formed in the bottom portion thereof and said annular gap forming means comprises an adjustable discharge plug arranged coaxially in said opening to produce said annular gap.

14. The apparatus of claim 12, wherein said annular gap forming means comprises an insert body coaxially positioned within said crucible, in said melt, comprising an upwardly open annular channel.

15. The apparatus of claim 14, further including an inoculating tube for removing said melt from said annular gap in the form of said tubing.

* * * * *